United States Patent [19]

Cherney et al.

[11] 4,345,133

[45] Aug. 17, 1982

[54] PARTIALLY SHIELDED MICROWAVE CARTON

[75] Inventors: Jerome A. Cherney, Appleton; Thomas D. Pawlowski, Neenah, both of Wis.

[73] Assignee: American Can Company, Greenwich, Conn.

[21] Appl. No.: 129,722

[22] Filed: Mar. 12, 1980

[51] Int. Cl.[3] ..... H05B 6/64

[52] U.S. Cl. ..... 219/10.55 E; 426/107; 229/3.5 MF; 229/43; 99/451

[58] Field of Search ..... 219/10.55 E, 10.55 F, 219/10.55 D, 10.55 R, 10.55 M; 426/107, 241, 243, 234; 229/3.5 MF, 31 FS, 32, 43; 126/390; 99/451; 220/DIG. 14, 450

[56] References Cited

U.S. PATENT DOCUMENTS

| | | | |
|---|---|---|---|
| 3,311,285 | 3/1967 | Korr | 426/107 X |
| 3,353,968 | 11/1967 | Krajewski | 219/10.55 E |
| 3,865,301 | 2/1975 | Pothier et al. | 219/10.55 E X |
| 3,935,415 | 1/1976 | Moore | 219/10.55 E X |
| 4,015,085 | 3/1977 | Woods | 219/10.55 E |
| 4,133,996 | 1/1979 | Fread | 219/10.55 E X |
| 4,144,438 | 3/1979 | Gelman et al. | 219/10.55 E |
| 4,190,757 | 2/1980 | Turpin et al. | 426/107 X |
| 4,196,331 | 4/1980 | Leveckis et al. | 219/10.55 E |
| 4,204,105 | 5/1980 | Leveckis et al. | 219/10.55 E |

*Primary Examiner*—B. A. Reynolds
*Assistant Examiner*—Philip H. Leung
*Attorney, Agent, or Firm*—Robert P. Auber; Stuart S. Bowie; Thomas D. Wilhelm

[57] ABSTRACT

A carton is disclosed having a paperboard receptacle and a cover fitting over the same; the cover being adapted to shield the top and sides of food material within the receptacle from microwave radiation, but allowing radiation to be admitted through the unshielded bottom of the receptacle. A surface of the cover is formed of a conducting metal which substantially inhibits the passage of microwave radiation therethrough. The depending cover wall which surrounds the side edges of the receptacle is constructed such that adjacent portions of the panels forming the cover wall are provided with a low impedance electrical connection at microwave frequencies to inhibit arcing between such panels during heating. The cover may be formed from a unitary, flat paperboard blank, in which case all corners of the various cover wall panels which will be in proximity to the surface on which the carton is supported during heating are rounded to minimize the electric field intensity created at these corners—thus reducing the likelihood that arcing will occur between various portions of the cover, or between the cover and the surface on which the carton is supported.

11 Claims, 5 Drawing Figures

PARTIALLY SHIELDED MICROWAVE CARTON

BACKGROUND OF THE INVENTION

1. Field of the Invention

This invention pertains generally to the field of paperboard packaging cartons, and particularly to cartons which are adapted to be used in microwave ovens in connection with the cooking of food contained within the cartons.

2. Description of the Prior Art

In the microwave cooking of various types of foods, it is often desirable to be able to shield a portion of the food from microwave radiation, while directing the radiation to other portions of the food. For some specific types of foods, it may actually be desirable to cook the food primarily by conduction heating, which is accomplished by shielding the major portion of the food product within a carton from microwave radiation, while utilizing a layer of microwave absorber in close proximity or contact with the food which heats the food as it absorbs radiation. A common example of a type of food product which should be heated in this way is frozen pizza—since it is very desirable that the bottom crust be heated thoroughly by conduction without overcooking the pizza sauce lying on top of the crust.

A number of package constructions have been devised which attempt to satisfy these objectives. For example, a laminate of metal foil and paper placed over the product within a paperboard carton has been used to shield the contents from radiation from the top and sides. Similarly, the food material has been packaged within a metal foil pouch having a cut-out window which allows the microwaves to be directed toward a predetermined portion of the food product. Other structures have used a layer of metal foil adhered to the surface of the carton itself to shield a portion of the food from the microwaves. While such known structures usually perform satisfactorily if the product is heated with the package intact, problems often arise if the consumer attempts to reheat food within the package after it has been opened.

Typically, once the integral structure of known shielded packages has been disrupted, there often exist separated portions of the metal foil which are split away from adjacent portions of the foil, or are layered adjacent to other foil portions not in direct electrical continuity therewith. In addition, sharp, crinkled edges in the foil may be formed during opening, and these sharp edges tend to develop high electric field intensities during application of microwaves. The result of such disruptions in the foil shield is the creation of very high potential differences between various points within the package as the package is subjected to microwave radiation. The electrical potentials can become sufficiently high that arcing takes place across the gaps between adjacent foil portions; since these gaps may contain paperboard or even portions of the food product, charring of the paperboard or food is common; on occasion, such arcing becomes so severe that the paperboard ignites.

SUMMARY OF THE INVENTION

The carton of the invention provides partial microwave shielding of a food product contained therein, while allowing the carton to be opened and reclosed by a user, and reheated in a microwave oven, without the danger of electrical arcing. The carton has a separate receptacle and cover: the cover lies over the receptacle portion and shields the contents of the receptacle from microwaves, while the receptacle is formed of unshielded paperboard to admit microwaves through its bottom.

The carton receptacle may be of conventional construction and preferably includes a bottom panel and upwardly extending side walls connected together to form a continuous wall about the bottom panel. The cover—normally resting on the top edges of the receptacle side walls when the package is closed—includes a cover top panel substantially conforming to the bottom panel and depending cover wall panels connected together to continuously encircle the sides of the receptacle. The cover wall panels are preferably slightly shorter than the height of the receptacle side walls so that the bottom edges of the cover wall panels are spaced slightly above the surface on which the carton rests; this feature minimizes the possibility of arcing between the shielding material of the cover and the support surface and inhibits discoloration of the support surface from products of combustion which was found to occur when the edges of the cover wall panels were very close to the support surface. The cover is formed of standard paperboard having a thin layer of metal foil—preferably aluminum—firmly laminated to a surface of the cover, e.g., the inner surface that faces the receptacle.

It has been discovered, as part of the present invention, that a prime cause of arcing between portions of metallic shielding material in a microwave package is due to the original provision or creation after opening of sharp, acute angled corners in the shielding metal foil. It has been found that sharp corners in the foil produce extremely high electric field intensities at the points of the corners which may be sufficient to cause arcing to adjacent, but disconnected portions of the foil, or to the surface on which the carton rests. It is therefore a prime object of the present invention to provide a carton cover structure which has no sharp corners in the shielding foil which are closely adjacent to the support surface or to other areas of foil which are separated from the corners by an air gap.

It is also a prime object of the invention to provide a cover structure wherein the depending cover wall panels are not only mechanically connected to one another, but are electrically connected to one another by a connection having low impedance at microwave frequencies so that high potential differences are not created between the individual panels which make up the cover wall—thus minimizing the possibility or arcing between these panels. These objects are achieved in the carton of the present invention even after the carton has been opened and reclosed by the consumer for reheating in a microwave oven.

The cover may be formed utilizing separated cover wall panels which are connected together by glue tabs. In such a case, for a rectangular cover top panel, two opposite cover wall panels have pairs of glue tabs extending from the side edges thereof, while the other two opposite cover wall panels do not. Each of the glue tabs has a metal foil layer thereof which is electrically continuous with the wall panel to which it is attached. All of the outwardly extending corners of the two cover wall panels without glue tabs are rounded, and the outwardly extending corners of the glue tabs are also rounded. The glue tabs are then adhered to either the inner or outer surface of the cover wall panels without tabs to form a substantially continuous depending cover wall. A capacitive coupling is formed between the foil on the glue tab and the foil on the adjacent cover wall panel which has a very low effective impedance at microwave frequencies—in the range of a few ohms.

The electrically continuous cover wall may also be formed by utilizing webbed corner panels which connect the adjacent cover wall panels along crease lines. The foil layer covers the entire inner surface of the cover, including the corner panels and the crease lines therein, so that electrical continuity is maintained between all points on the inner surface of the cover. Each webbed corner panel folds up along a crease line and folds inwardly to be adhered against the outside surface of one of the cover wall panels. The layers of metal foil at the corners are again capacitively coupled to one another so that the effective impedance at microwave frequencies is very low. This construction has the additional advantage that, even if a corner panel releases or is torn from the wall panel to which it is glued, a low impedance electrical connection between adjacent cover wall panels will still be maintained. All of the corners of the webbed corner panels and their junctions with the cover wall panels are rounded, so that no sharp corners in the foil are created when the cover is glued into finished form.

Further objects, features, and advantages of the invention will be apparent from the following detailed description and the accompanying drawings.

DESCRIPTION OF THE PREFERRED EMBODIMENT

Figure 1:
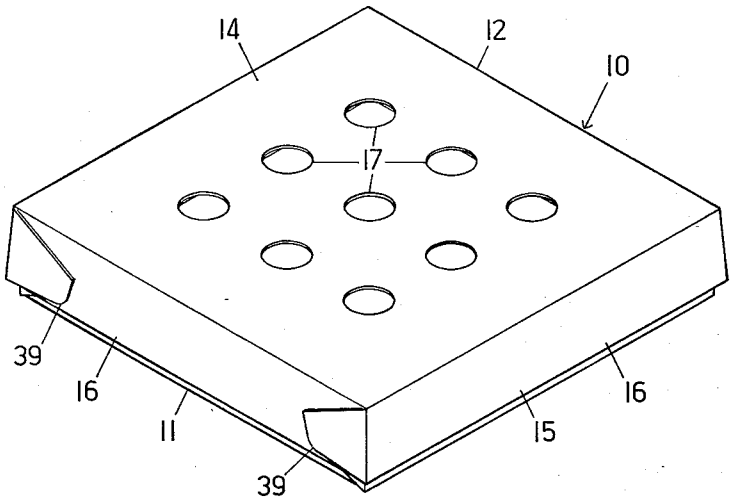
FIG. 1 is a perspective view of a carton in accordance with the invention, shown in closed position.

With reference to the drawings, an external perspective view of a carton embodying the invention is shown generally at 10 in FIG. 1. The carton 10 includes a receptacle 11, the bottom portion only of which is discernible in FIG. 1, and a cover 12.

The cover 12 includes a generally rectangular cover top panel 14 and a skirt-like cover wall 15 which depends downwardly from the peripheral edges of the cover panel 14 to encircle the receptacle 11. The bottom edges 16 of the cover wall are spaced just above the bottom of the receptacle 11 when the cover is in its normal rest position on the receptacle, as shown in FIG. 1. The cover top panel 14 has a plurality of openings 17 therein which are optionally provided to allow easy venting of vapors generated within the carton during cooking.

Figure 2:
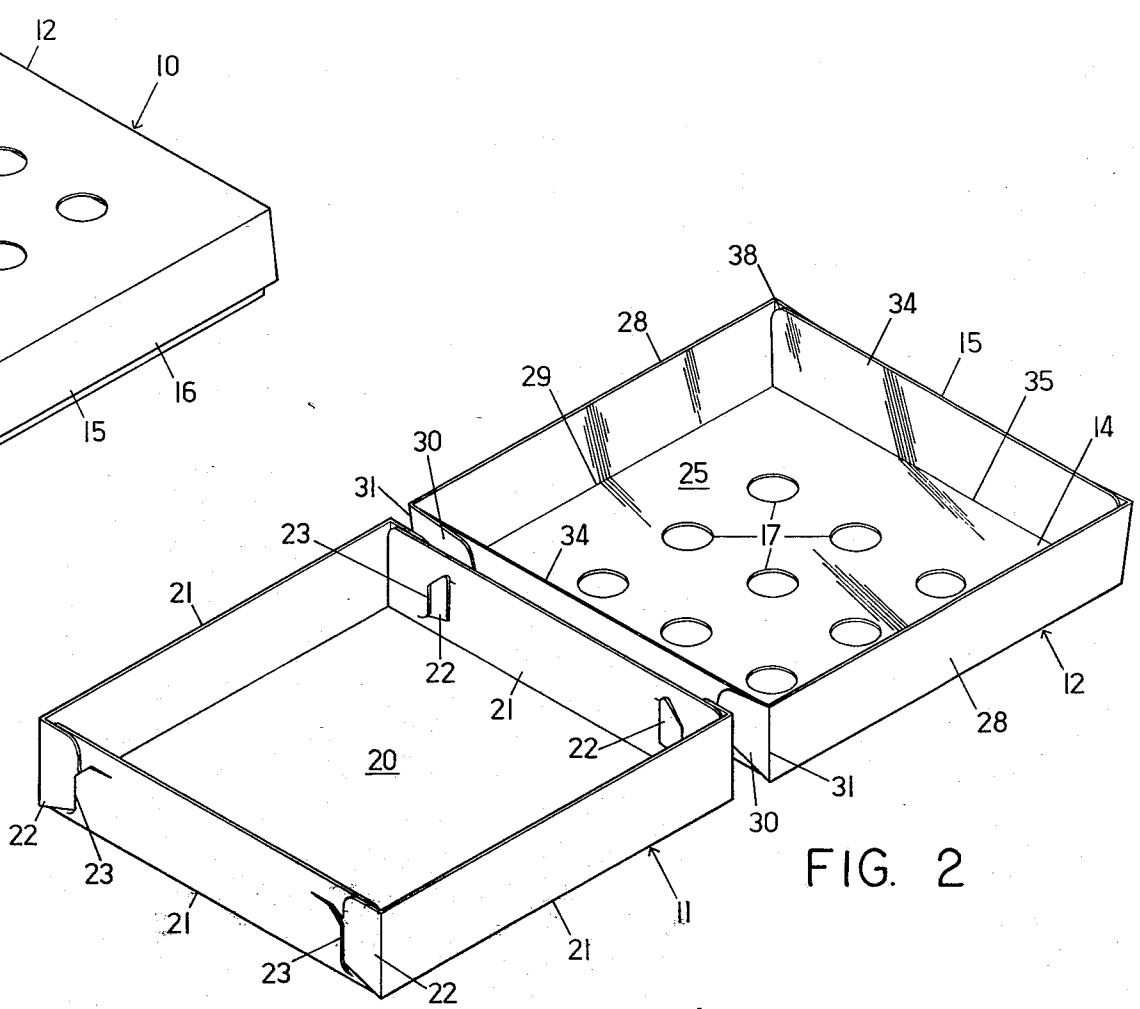
FIG. 2 is a perspective view of the carton of FIG. 1 shown in opened position.

The carton is shown in its open position in FIG. 2; the step of opening by the consumer simply involves the lifting of the cover from the receptacle. The receptacle itself is not critical to the invention, and may be of any construction which does not shield the interior of the receptacle from microwaves with conductive surfaces. In the embodiment shown in FIG. 2, the receptacle has a generally rectangular bottom panel 20 and upright receptacle side wall panels 21 which are connected together by locking tabs 22; the locking tabs, extending from the side edges of two opposed receptacle wall panels, are engaged through slits 23 cut in the other opposed receptacle wall panels to thereby mechanically connect all of the receptacle walls together. While the receptacle may be formed of any suitable material which is not highly electrically conductive, standard grades of paperboard will be satisfactory for most applications.

The cover 12 is formed of a paperboard layer having a conductive metal foil layer 25 tightly laminated thereto. The metal foil forms the inner surface of the cover 12—the surface facing the receptacle—and thus shields both the top of the receptacle and substantially all of the sides of the receptacle from microwave radiation. The metal foil layer could as well be laminated to the entire outer surface of the cover instead of the inner surface; an incidental advantage of foil on the inner surface is that it inhibits absorption of moisture into the paperboard from food within the carton. A small amount of microwave energy is admitted into the top of the cover through the openings 17 (which, for example, may be in the range of one-half inch (1.27 cm.) in diameter), but this energy is not sufficient to substantially affect the cooking of the food product therein. A small amount of microwave energy also passes through the sides of the receptacle in the area between the bottom edges 16 of the cover wall 15 and the level of the bottom panel 20 of the receptacle. The spacing between the bottom edges 16 and the level of the bottom panel 20 is provided to inhibit deposition of combustion products on or arcing to the surface on which the carton rests, but is not so large as to admit substantial amounts of microwave energy through the sides of the carton; a spacing of 1/16 inch to ⅛ inch (1.59 mm. to 3.19 mm.) has been found to be satisfactory for most purposes. It has been observed that, if the bottom edges of the cover panels touch or are closely adjacent to the support surface, a brown oxidation residue is deposited on the support surface around the carton.

A cover could be formed which had high conductivity between all cover wall panels, for example, by die pressing a one piece paperboard blank into a three-dimensional cover having upright sides; metal foil shielding would be laminated to the cover blank either before or after die pressing, or metal could be deposited on the inner surface of the cover by various techniques after such die pressing. A cover formed in this manner would have no sharp corners in the foil coating and perfect continuity around the cover wall 15. However, such constructions are generally expensive and difficult to produce in large quantity.

In the present invention, it is possible to achieve the advantages of a cover formed in the foregoing described manner while utilizing covers formed from one-piece flat blanks. Such a cover is shown in FIG. 2, in which the cover wall 15 includes a first pair of cover wall panels 28 integrally joined by crease lines 29 to opposite side edges of the cover top panel 14. Each of the cover wall panels 28 has a pair of glue tabs 30 integrally connected to the side edges thereof along crease lines 31. The glue tabs 30 are glued to a second pair of cover wall panels 34 which are integrally connected to opposite side edges of the cover top panel 14 by crease lines 35.

Figure 3:
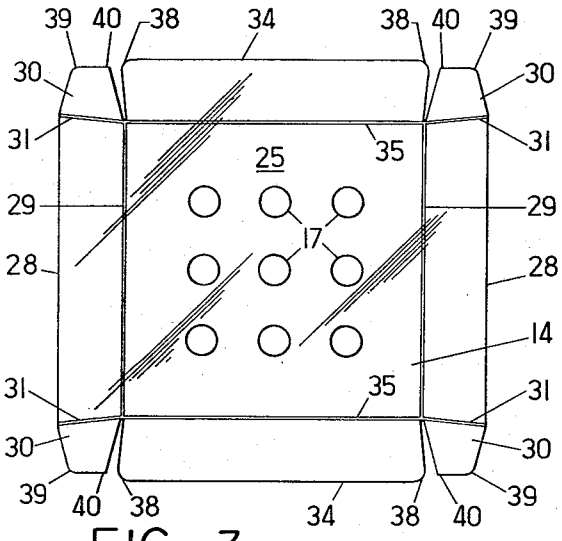
FIG. 3 is a plan view of a blank from which the cover portion of the carton of FIG. 1 may be assembled.

The details of construction of the cover 12 are best shown with reference to FIG. 3—a plan view of the flat blank from which the cover is erected. The particular blank shown in FIG. 3 is designed to provide, when erected, an outwardly flared cover wall 15 which facilitates the removal and replacement of the cover on the receptacle. The flare in the erected cover wall is produced because the cover wall panels 28 and 34 have outwardly flaring side edges.

Sharp corners in the metal foil conductive surface 25 are avoided by rounding off the corners of the cover wall panels and the glue tabs 30 attached thereto. For example, the outside corners 38 of the opposed cover wall panels 34 are rounded (for example, with a ⅛ inch (3.19 mm.) radius), and the outside corners 39 of the glue tabs 30 are similarly rounded. The inside edge corners 40 of the glue tabs 30 are not shown rounded—although they may optionally be rounded if desired—for the reason that these corners will not be in proximity to the surface upon which the erected carton will be supported during microwave heating. It may be noted that the corners 38 and 39 will be in close proximity to the support surface when the carton is erected. In addition, the corners 38 of the side wall panels 34 will also be in close proximity to the conductive foil surface of the adjacent side wall panel 28. Thus, if the corners 38 were not rounded, high electric field intensities could be produced at these corners which could result in arcing to the nearby surfaces of the panels 28 or the glue tabs 30.

The conductive metal foil extends entirely across the inner surface 25 of the blank, including the crease lines 29, 31, and 35. Because the foil lying over the crease lines will not be broken as the cover is folded about these lines, good electrical continuity across all surfaces will be maintained.

As indicated above, the metal foil forming the conductive surface 25 is preferably aluminum foil. A foil having a thickness of 0.35 mils (8.9 microns), firmly adhered to the paperboard surface utilizing a polyvinyl acetate in water emulsion (e.g., Borden's E-1433-C), has been found to be satisfactory. The glue tabs 30 are preferably glued either to the inside or outside of the adjacent cover wall panels 28 utilizing the same adhesive. Since this adhesive is a water based emulsion, it adds a small amount of moisture to the approximately 5% moisture content of the normal paperboard of which the cover is formed.

In the erected carton, the foil on each glue tab cooperates with the foil on the cover wall panel to which its adhered, to effectively form a parallel plate capacitor. As an illustrative example, if the glue tabs have an area of about 4 $cm^2$ (e.g., 2 cm×2 cm), and the paperboard of the carton has a thickness (the plate separation between the foil layers) of 20 mils (about 0.5 mm.), the capacitance between the foil layers will be in the range of 1 pf if the paperboard is assumed to have the dielectric coefficient of air. In practice, the dielectric coefficient will be higher than that of air because of the moisture content of the paperboard. This moisture content is enhanced by the use of water-based adhesives to adhere the glue tabs to the wall panels. At typical frequencies encountered in microwave ovens, e.g. 2.45 GHz, the effective impedance of even a one pf. capacitor is quite small, in the range of four ohms. This low impedance electrical connection provided between the cover wall panels at microwave frequencies generally precludes the buildup of potentials between panels which would be sufficiently high to result in arcing.

It is apparent that the greater the spacing between the glue tab foil and the wall panel foil, the lower will be the capacitance between these surfaces and the higher the effective impedance—which explains why arcing is observed to occur when a glue tab breaks away from the wall panel to which it was adhered. However, it has been found that solid bleached sulphite paperboard having a thickness up to 65 mils can be utilized, using the adhesive described above to adhere the glue tabs to the adjoining cover wall, without encountering arcing or charring of the paperboard which has been sandwiched between the metal foil on the glue tab and the metal foil on the inner surface of the adjoining cover wall panel 34. It is believed that sufficient capacitive coupling exists between these foil surfaces through the paperboard to prevent the formation of arcs. To minimize the likelihood that arcing will occur, it is preferred that the thickness of the paperboard—and thus the spacing between the two foil surfaces—be no more than approximately 20 mils.

If one of the glue tabs separates from the adjacent cover wall panel 34 to which it has been glued, it is very likely—for the reason noted above—that arcing will take place between the glue tab and the cover wall panel. Such separation is relatively unlikely to occur with the carton of the present invention since the consumer does not have to disturb the integrity of the cover when opening the carton. Hermetic sealing of the product contained within the carton may ordinarily be achieved by providing a sealed pouch around the food product within the carton, or enclosing the entire carton in a plastic bag which is sealed about the carton to keep moisture in and air out, and to physically hold the carton cover and receptacle together.

Figure 4:
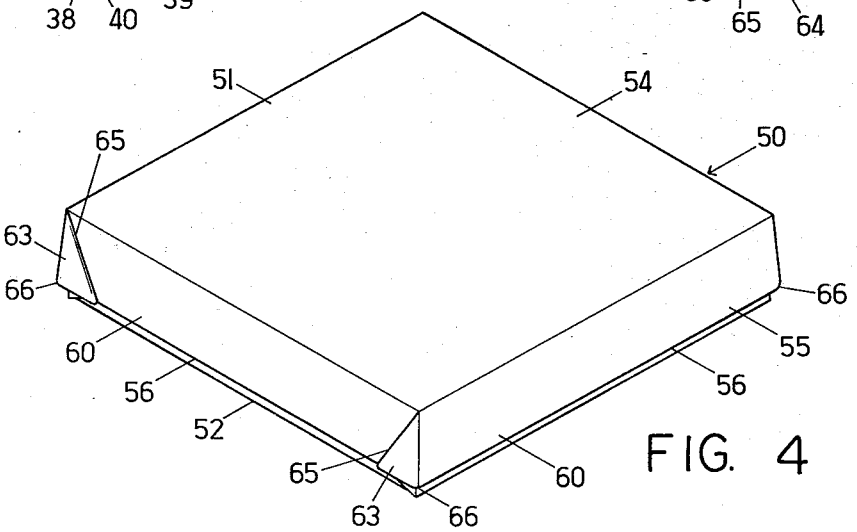
FIG. 4 is a perspective view of another embodiment of a carton in accordance with the invention.

A carton in accordance with the invention having a cover which can be formed from another type of carton blank is shown generally at 50 in FIG. 4. The carton 50 includes a cover 51 emplaced on a receptacle 52; the receptacle 52 may be formed in the same manner as described above for the receptacle 11, and thus may be of any standard construction which does not provide shielding of the product therein. The cover 51 has a cover top panel 54 and a cover wall 55 depending downwardly therefrom and encircling the receptacle 52. The bottom edges 56 of the cover wall 55 are preferably spaced slightly above the bottom of the receptacle 52, for the same reasons as described above in connection with the carton 10. In the embodiment of the carton 50 shown in FIG. 4, the cover top panel 55 does not have any openings therein to outlet vapors generated within the carton; however, since the cover is not sealed to the receptacle, vapors can nonetheless escape through the loose joint formed where the cover contacts the receptacle.

Figure 5:
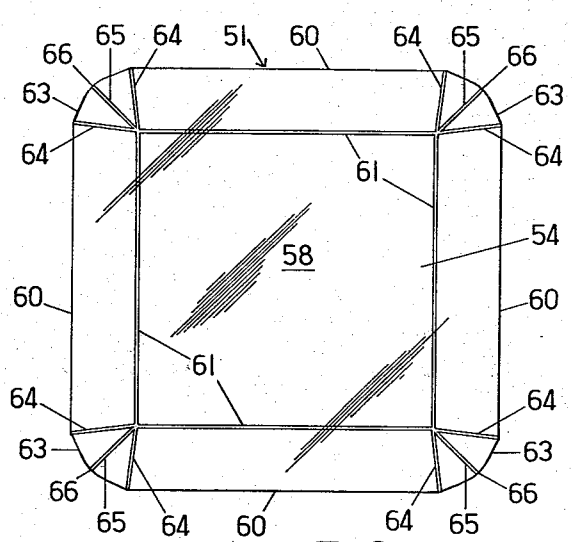
FIG. 5 is a plan view of a blank which can be assembled to form the cover portion of the carton shown in FIG. 4.

The cover 51 is formed of a layer of standard paperboard material having a layer of electrically conductive metal foil 58 laminated to the inner surface thereof—the surface that faces the receptacle 52. A plan view of the one-piece blank from which the cover 51 is formed, with the conductive surface 58 facing upwardly, is shown in FIG. 5. The cover wall 55 is formed from cover wall panels 60 which are integrally connected to the side edges of the cover top panel 54 by crease lines 61. Continuity between the cover wall panels 60 is provided by webbed corner panels 63 which are integrally connected between adjacent cover wall panels 60 by crease lines 64, and each corner panel has a crease line 65 running through the center of the panel which allows the corner panel to fold outwardly about this crease line. The electrically conductive foil 58 extends over the entire inner surface of the cover panel, including over all of the crease lines, so that electrical continuity is provided between all points on the cover's inner surface.

The advantages of this type of construction are best illustrated in the view of the assembled carton shown in FIG. 4. In this view, the webbed corner panels 63 have been folded outwardly about the center line 65 such that the crease lines 64 (not shown in FIG. 4) of adjacent cover wall panels 60 align with one another. During assembly of the cover, each outwardly extending folded corner panel 63 is then folded back over such that one of the outside surfaces of the folded cover panel makes contact with the outside surface of a cover wall panel 60; these abutting surfaces are adhered together, preferably using a water base emulsion adhesive which may be of the polyvinyl acetate type described above. From an examination of the blank of FIG. 5, and the description just above of the assembly of the blank into the cover, it will be apparent that, even though the crease lines 64 of adjacent cover wall panels 60 are very close to, if not actually touching one another after assembly of the cover, no arcing will take place between these areas because the foil on the surface of the corner panel 63 provides an electrically conductive path between these two areas and because the abutting foil provides a capacitive coupling; together, these features provide a low impedance connection between wall panels which prevent the build up of large potential differences. Similarly, even though each webbed corner panel 63 is folded over such that the foil forming the inside surface of the corner panel is separated by two layers of paperboard from the foil forming the inside surface of the abutting cover wall panel 60, no arcing should take place between these foil surfaces because they are capacitively coupled and because a highly conductive electrical path is provided across the foil covering the crease line 64; even if the folded corner panel should separate from contact with the cover wall panel to which it was adhered, no arcing is observed to occur.

As shown in FIG. 5, each corner panel 63 comprises two symmetrical, triangularly shaped panels which are joined together by the center crease line 65. The outside edges of the symmetrical portions of the corner panel intersect at the outer terminus 66 of the crease line 65. Since the intersections 66 will be in proximity to the surface on which the carton will be supported during microwave heating, these intersections or corners are also rounded so as to prevent the development of high electric field intensities.

To facilitate the emplacement of the cover on the receptacle, it is preferred again that the cover wall 55 flare slightly outwardly from the cover top panel 54. Such flaring is provided by having the side edges of the cover panels 60, as defined by the crease lines 64, flare slightly outwardly, as shown in FIG. 5.

The details of the construction of the laminate of foil and paperboard which forms the cover 60 are identical to the construction details as described above for the carton 10, and the considerations which dictate these construction details are also the same.

It is understood that the invention is not confined to the construction and arrangement of parts herein illustrated and described, but embraces all such modified forms thereof as come within the scope of the following claims.

We claim:

1. A carton adapted to partially shield the contents thereof from microwave radiation, comprising:

(a) a carton receptacle formed of paperboard without shielding, having a bottom panel and vertical side wall panels formed integrally therewith and extending upwardly therefrom, said side wall panels being connected together to form a continuous side wall about said bottom panel; and (b) a carton cover separate from the receptacle disposed over said receptacle, including:

(1) a cover top panel formed of paperboard and having substantially the same size and shape as said receptacle bottom panel, and having side edges about the periphery thereof, (2) paperboard cover wall panels integrally connected with and depending downwardly from the side edges of said cover top panel, said cover wall panels being connected together to form a continuous cover wall about said cover top panel, (3) one entire surface of said cover top panel and of said cover wall panels having a layer of conductive metal in electrical continuity laminated thereto which is selected to substantially inhibit the passage of microwaves therethrough.

(4) means for providing a capacitive electrical connection between the conductive surfaces on adjacent cover wall panels forming said cover wall having low impedance at microwave frequencies, such that arcing between adjacent cover wall panels during microwave heating is inhibited, (5) the height of said cover wall panels being less than the height of said receptacle wall panels so that the bottom edges of the cover wall panels and laminated conductive metal layer will be spaced above the level of the bottom surface of the bottom panel a distance of at least approximately 1/16 inch to inhibit discoloration of the surface on which the bottom panel rests when the inside surface of the cover top panel rests on the top edges of the receptacle side wall panels and the carton is subjected to microwave radiation, and (6) all corners formed in said cover wall panels which are in closest proximity to the level of said receptacle bottom panel being rounded to thereby minimize the electric field intensity at such corners.

2. The carton of claim 1 wherein said receptacle bottom panel and said cover top panel are both rectangular, and wherein said means for providing an electrical connection includes a pair of glue tabs extending from the side edges of two of said cover wall panels which extend from opposite edges of said cover top panel, each of said glue tabs having the corners thereof rounded which are in closest proximity to the level of said receptacle bottom panel, said glue tabs having a metal conductive layer laminated tightly thereto which is in electrical continuity with the conducting metal on the cover wall panels to which said glue tabs are connected, said glue tabs being adhered to a surface of the adjacent cover wall panel not having glue tabs thereon so as to form a continuous depending cover wall about the periphery of said cover top panel, whereby a capacitive coupling is formed between the metal layer on the glue tab and the metal layer on the adjacent cover wall panel which has low impedance at microwave frequencies.

3. The carton of claim 1 wherein said cover is formed of a unitary blank having a substantially rectangular cover top panel and cover wall panels integrally connected therewith by crease lines lying along the peripheral edges of said cover top panel, and wherein said means for providing an electrical connection includes webbed corner panels integrally connected between adjacent cover wall panels by crease lines, each of said corner panels having a central crease line formed therein to divide the corner panel into two symmetrical parts, the entire inner surface of said cover, including said top panel, cover wall panels, corner panels, and all the crease lines connecting the same, having a layer of conductive metal laminated thereto to provide electrical continuity between all points on the metal layer on said cover, said corner panels being folded outwardly about their central crease lines and folded inwardly and adhered to the outer surface of an adjoining cover wall panel, and the corners formed at the intersection of the outer edges of the symmetrical portions of said corner walls panels at the terminus of the central crease line being rounded so as to minimize the electric field intensity produced at such corner during microwave heating.

4. The carton of claim 1, 2 or 3 wherein said conductive metal layer comprises aluminum having a thickness of approximately 0.00035 inch, said layer being tightly and uniformly adhered to the paperboard of said cover.

5. The carton of claim 4 wherein said conductive layer is adhered to the paperboard with a water-based emulsion adhesive.

6. The carton of claim 1 wherein the bottom edges of said cover wall panels are spaced approximately 1/16 to ⅛ inch above the level of said receptacle bottom panel.

7. The carton of claim 1, 2 or 3 wherein the side edges of each of said cover wall panels forming said cover wall flare outwardly such that said cover wall forms an outwardly flared skirt surrounding said carton receptacle to facilitate the replacement of said cover on said receptacle.

8. The carton of claim 1, 2 or 3 wherein said cover top panel has at least one opening therein to allow venting of vapors generated within the carton during heating.

9. The carton of claim 1, 2 or 3 wherein the paperboard of which said cover is formed is less than 0.065 inch in thickness.

10. The carton of claim 1, 2 or 3 wherein the paperboard of which said cover is formed is less than 0.02 inch in thickness.

11. The carton of claim 2 wherein said glue tabs are adhered to said cover wall panels with a water-based emulsion polyvinyl acetate adhesive.

* * * * *